United States Patent [19]

Sawa et al.

[11] 3,933,531

[45] Jan. 20, 1976

[54] METHOD OF RUST-PREVENTING FOR COPPER AND COPPER ALLOY

[76] Inventors: Natsuo Sawa, 651 Horie, Tadotsu-cho; Masahiro Hoda, 321-3 Minamikamo, Tadotsu-cho, both of Nakatado, Kagawa, Japan

[22] Filed: June 24, 1974

[21] Appl. No.: 482,165

Related U.S. Application Data

[63] Continuation-in-part of Ser. No. 243,048, April 11, 1972, abandoned, which is a continuation-in-part of Ser. No. 3,482, Jan. 16, 1970, abandoned.

[52] U.S. Cl. ..... 148/6.14 R; 148/31.5; 106/14; 21/2.5 R; 252/390

[51] Int. Cl.[2] ..... C23F 11/00

[58] Field of Search ..... 106/14; 252/390, 391, 148, 252/394; 148/6.14 R, 6.31; 260/309, 309.2

[56] References Cited

UNITED STATES PATENTS

| | | | |
|---|---|---|---|
| 2,468,163 | 1/1948 | Blair, Jr. et al. | 252/390 |
| 2,618,608 | 9/1952 | Schaffer | 106/14 |
| 3,140,974 | 7/1964 | Pera et al. | 106/14 |
| 3,295,917 | 1/1967 | Cotton | 21/2.5 R |

*Primary Examiner*—Ralph S. Kendall
*Assistant Examiner*—Charles R. Wolfe, Jr.
*Attorney, Agent, or Firm*—Haseltine, Lake & Waters

[57] ABSTRACT

Copper and copper alloys are prevented from rust by surface-treating the copper and copper alloys with at least one compound selected from the class consisting of alkylimidazoles represented by the following formula:

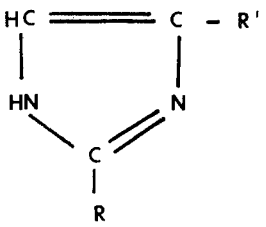

wherein R is a long straight chain alkyl group of 5–21 carbon atoms and R′ is hydrogen atom or a lower alkyl group, and their acid addition salts. The compound is used as it is, or in a solution, by dipping, spraying, coating or directly contacting with copper or copper alloy. The surface -treated copper and copper alloy can well withstand tarnishing in an atmosphere containing sulfur compound gas.

21 Claims, No Drawings

METHOD OF RUST-PREVENTING FOR COPPER AND COPPER ALLOY

This application is a continuation-in-part application of application Ser. No. 243,048, filed Apr. 11, 1972, and now abandoned which was a continuation of patent application Ser. No. 3,482, filed Jan. 16, 1970, and now abandoned.

This invention relates to a method for rust-preventing copper and copper alloy, and more particularly to such method by surface-treating the copper and copper alloy with a 2-alkylimidazole or an acid addition salt thereof.

Copper or a copper containing metal is gradually contaminated in the atmosphere and loses its proper colour tone and gloss, and particularly in the atmosphere containing a sulfur compound such as hydrogen sulfide, carbon disulfide and sulfur dioxide, rapidly undergoes not only tarnishing but also considerable decrease in its commercial value due to the blackening of the surface caused by the formation of copper sulfide.

As a result of strenuous studies on the rust-prevention of copper and the copper alloy, the inventors have found that a remarkable rust-preventing effect can be attained upon the copper or copper alloy by surface-treating the copper or copper alloy with a solution containing a 2-alkylimidazole represented by the following general formula:

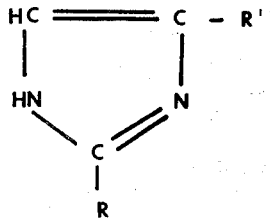

wherein R is a long straight chain alkyl group having 5 to 21 carbon atoms and R′ is a hydrogen atom or a lower alkyl group, or an acid addition salt thereof.

The 2-alkylimidazoles suitable for carrying out the present invention are such compounds as being readily obtainable from an alkyl cyanide and 1,2-alkylenediamine according to the method disclosed in Japanese patent specification No. 446482, among which typically are, 2-amylimidazole (m.p. 38°C), 2-heptylimidazole (m.p. 45°–46°C), 2-decylimidazole (m.p. 69°–70°C), 2-undecylimidazole (m.p. 75°–75.5°C), 2-dodecylimidazole (m.p. 77°–78°C), 2-tridecylimidazole (m.p. 81°–82°C), 2-tetradecylimidazole (m.p. 83°–84°C), 2-heptadecylimidazole (m.p. 88°–89°C), 2-undecyl-4-methylimidazole (m.p. 37°–38°C), and 2-heptadecyl-4-methylimidazole (m.p. 42°–45°C).

These imidazoles can form an addition salt having a definite melting point with various mineral acids or organic acids owing to their tertiary nitrogen atom. Preferably, these salts are water-soluble and are either colorless or produce no color which would mask the color of the copper.

The typical salts include, for example, 2-undecylimidazolium monophosphate (m.p. 144.5°–146°C), 2-undecyl-4-methylimidazolium maleinate (m.p. 45°–48°C), 2-undecyl-4-methylimidazolium laurate (m.p. 41°–44°C), 2-undecyl-4-methylimidazolium stearate (m.p. 52°–54°C), 2-undecyl-4-methylimidazolium sulfate (m.p. 60°–62°C), 2-undecyl-4-methylimidazolium monophosphate (m.p. 104°–105°C), 2-heptadecylimidazolium monooxalate (m.p. 154°–155°C), 2-heptadecylimidazolium monosuccinate (m.p. 119°–121°C), 2-heptadecyl-4-methylimidazolium monophosphate (m.p. 117°–119°C), and 2-heptadecylimidazolium monophosphate (m.p. 158°–159°C).

The surface treatment according to the present invention is carried out in the following manner:

Copper or the copper alloy, of which surface has been cleaned according to such ordinary method as polishing, acid pickling or cleaning with an aqueous solution of alkali metal cyanide, is dipped in a solution containing said imidazole or salt thereof at room temperature for a short time (sufficient with a few minutes), taken out of the solution, water-washed if necessary and then dried.

In carrying out the present surface treatment, it is only necessary that the metal surface be in contact with the solution, and therefore it is recognized that the similar rust-preventing effect can be obtained by coating the metal surface with the solution or spraying the solution onto the metal surface in place of the dipping.

The scheme of the rust-preventing treatment of the present invention has not yet been made clear, but seems to be based on the following mechanism.

That is to say, the cleaned surface of copper or the copper alloy reacts with an—HN—group of the imidazole ring and some bond is formed between the copper atom and the imidazole molecule. In that case, the—N-H—group acts as an anchor. The hydrogen atom generated by the reaction is adsorbed onto the copper metal in the form of adsorption hydrogen. Then, an—NH—-group of the other imidazole molecule is associated with the tertiary nitrogen of the imidazole bonded to the copper surface, and these tertiary nitrogen and the—NH—group are combined together with hydrogen bondage. Such bondage is also assisted by the micelle formation of the long straight chain alkyl group at the same time. Thus, when once the imidazole molecule has been deposited on the copper surface, new imidazole molecules are gradually attracted one by one on to the preceding imidazole molecule by the two actions, namely hydrogen bondage and micelle formation, and thus the copper surface is coated with the micelles of the imidazoles.

As explained above, the desired rust-preventing effect can be attained by the four factors, that is, a role of anchor, adsorption hydrogen, micelle formation and imidazole ring. Even if one of these four factors lacks, no satisfactory effect can be expected. That is, such an imidazole of which bonding force towards the copper is eliminated by replacing the hydrogen atom of the—N-H—group with a carbon atom. For example, imidazoles substituted at 1-position, have no rust-preventing effect, even if they have a long straight chain alkyl group. Further, imidazolines having no carbon-carbon double bond on the ring, though having an—NH—group, are hardly able to bond the copper to the—NH—group, and thus have no rust-preventing effect, despite their long straight chain alkyl group.

Furthermore, the imidazoles having no long straight chain alkyl group at the 2-position have no ability to form a micelle and thus have no satisfactory rust-preventing effect.

In the foregoing, the scheme, when a free base is used, has been explained, but the scheme in case where acid addition salts of 2-alkylimidazoles are used, will be also included in the same category as above, because the acid addition salts are converted to free bases through the following step.

That is, an acid addition salt of imidazole is dissociated to an imidazolium cation and an acid anion in an aqueous solution, and the dissociated anion reacts with the copper to form a copper salt. The copper salt is dissolved in the aqueous solution, but electron released at the dissolution of the copper salt acts upon the imidazolium cation to form a free base and a hydrogen atom. The formed hydrogen atom is adsorbed onto copper.

It can be said from the foregoing schemes that any solvent can be used to prepare the solution so long as it can dissolve the imidazole or its acid addition salt. However, as the 2-alkylimidazole used in the present invention has a long straight chain alkyl group, it is hardly soluble in cold water, and thus it is not appropriate to use water alone as a solvent for preparing the solution. However, it is soluble in an organic solvent or water containing an organic solvent, and the organic solvent is preferable for preparing the solution.

Typical organic solvents usable in the present invention include, for example, methanol, ethanol, 1-propanol, 2-propanol, ethyleneglycol, propyleneglycol, acetone, acetonitrile, dioxane, pyridine, lutidine, benzene, toluene, n-hexane, trichlene, and carbon tetrachloride.

In order to form micelles on the surface of copper or a copper containing metal, free supply of imidazole is necessary, and thus it is desirable that the imidazoles are sufficiently dissolved in the solution. However, the imidazole molecules on the deposited micelle surface are eluted inversely into the solution, if the dissolving action of the solution is strong, and the micelles are thereby peeled off. Accordingly, when the surface treatment is carried out by dipping or immersion, it is desirable, in view of a balance between the micelle formation and the micelle peeling, to dissolve the imidazoles or their acid addition salts in a solution mixture of an organic solvent and water to weaken the eluting action of the solution and use the resulting solution mixture.

In order to form a solvent mixture of water and an organic solvent, it is preferable to use a water-soluble organic solvent, but a water-insoluble organic solvent also may be used for an emulsion or a dispersion.

The mixing ratio of water to an organic solvent depends upon the kind of an organic solvent used, but usually the 1:1 ratio by equivalent of water to an organic solvent is, not exclusively, preferable by experience.

When the surface treatment of copper or copper alloy is carried out by spraying the solution on to the copper or copper alloy or coating the surface of copper or copper alloy with the solution, the solvent is volatilized away, and thus the precaution for the micelle peeling is not so necessary as in the dipping method.

It is further remarkable that a satisfactory rust-preventing action is observable even by contact of the surface of copper or a copper containing metal with a 2-alkylimidazole or an acid addition salt thereof in a vaporized state. Accordingly, by impregnating such adsorbable material as an impregnation paper with a solution containing a 2-alkylimidazole or acid addition salt thereof and laying the material extended over the surface of copper or copper alloy, the imidazole always comes in contact with the metal surface in a vaporized phase, and thereby the desirable rust-preventing effect can be attained.

Further by adding the imidazole to lubricating oil, etc. The rust preventing of the metal surface in contact with such lubricating oil, etc. can be sufficiently attained.

The acid addition salts of 2-alkylimidazoles are soluble in water and alcoholic solvents, but sparingly soluble essentially in non-polar solvents. Thus, in preparing the solution, water is most suitable in view of the balance between the micelle formation and the micelle peeling, as explained above, referring to the scheme. However, the solvent is not always restricted to water, and an aqueous solution of an organic solvent, or an emulsion or a dispersion of an organic solvent and water may be used, in case of which there is recognized no particularly better result than use of water.

In order to promote cleaning of the metal surface, a mineral acid or an organic acid in a molar amount less than that of alkylimidazole used can be added to the solution in advance. In that case, the acid immediately reacts with the imidazole to form an acid addition salt.

Accordingly, a mixture of the alkylimidazole and the acid addition salt of alkylimidazole or acid addition salt of amine can be added to the solution as an effective component in advance for such a purpose. In that case, the acid addition salts of such well-known amines as, for example, dimethylamine, methylamine, ethylenediamine, ethylamine, ethanolamine, aniline, and pyridine are suitable as the acid addition salts of amine used in the present invention. These salts release anions in the solution and the released anions are conbined, more or less, with metal cations to form metal salts. The resulting metal salts are dissolved in the solution, whereby the metal surface is cleaned.

The usable typical acids include acetic acid, capric acid, glycolic acid, para-nitrobenzoic acid, para-toluene sulfonic acid, picric acid, oxalic acid, succinic acid, maleic acid, fumaric acid, tartalic acid, adipic acid, hydrochloric acid, sulfuric acid, and phosphoric acid. Of course, such auxiliary means for cleaning is not necessary, when the acid addition salt of imidazole is used.

The temperature for the present surface treatment is in a range of from the room temperature to about 200°C but the use of the room temperature, which necessitates no heating means, is most advantageous.

Various concentrations of the imidazole in the solution can be used, but usually the solution must have an imidazole concentration of at least 0.01% by weight, preferably 0.05–5% by weight. Excess concentration is not econimically preferable.

The present invention will be now explained in detail referring to examples:

EXAMPLE 1

A 2-cm square copper plate was polished with a sand paper, defatted with benzene and, cleaned with an aqueous solution of potassium cyanide. The thus cleaned plate was dipped for one hour into a solution prepared by dissolving 0.1g of 2-undecyl-4-methylimidazole in a solvent mixture consisting of 55 ml of methanol and 45 ml of water at room temperature, then washed with water, naturally dried and subjected to an air exposure test in a house provided with a sulfur recovery unit in a plant for producing carbon disulfide (the house is full of hydrogen sulfide, sulfur dioxide gas and sulfur vapour at relatively high concentrations). The control test piece (untreated) underwent color change after 8 hours, whereas the treated test piece did not undergo color change even after 4 days. The test piece treated with commercially available benzotriazole (treating conditions: dipping in a 0.25% aqueous solution at 60°C for 5 minutes) underwent color change after 2 days.

EXAMPLE 2

Test was carried out in the same manner as in Example 1, except that a solution prepared by dissolving 0.09 g. of 2-undecyl-4-methylimidazole and 0.01 g of 2-undecyl-4-methylimidazole phosphate into a solvent mixture consisting of 55 ml of methanol and 45 mol of water was used instead, and the similar results of those of Example 1 were obtained.

EXAMPLE 3

A solution consisting of 0.1 g of 2-undecyl-4-methylimidazole and 100 ml of methanol was sprayed onto a copper plate cleaned in the same manner as in Example 1, and as a result, almost similar rust-preventing effect to that of the Example was obtained.

EXAMPLE 4

Test was carried out in the same manner as in Example 1 except that a brass plate was used in place of the copper plate of Example 1. The control test piece (untreated) underwent color change after 4 days and pitting was observed, whereas the treated test piece did not undergo color change even after 14 days and no pitting was observed.

EXAMPLE 5

10 ml of methanol containing 8.84 g (0.078 mole) of dissolved 85% phosphoric acid was added to 50 ml of methanol containing 20 g (0.092 mole) of dissolved 2-undecylimidazole under ice cooling, and the resulting crystal deposits were filtered and recrystallized with ethanol solvent, whereby 21.8 g of phosphate was obtained. The melting point of the phosphate was 144.5°–146°C.

0.1 g of the thus obtained crystal was dissolved in a solvent mixture consisting of 55 ml of methanol and 45 ml of water to prepare a solution, and a copper plate was coated with the thus obtained solution, dried, and subjected to the same exposure test as in Example 1. No color change was observed even after 5 days.

EXAMPLE 6

1 g of powders of 2-undecyl-4-methylimidazole and a polished and cleaned 2-cm square copper plate were placed separately in a tightly sealed vessel of 5l capacity and stored at room temperature for two days and then hydrogen sulfide was introduced into the vessel so that the hydrogen sulfide concentration might be 10 ppm, but it took 1.5 days until a tarnish was observed on the copper plate surface.

On the other hand, the copper plate stored under the same conditions in the vessel free of the 2-undecyl-4-methylimidazole and subjected to hydrogen sulfide atmosphere underwent complete color change after a half day.

EXAMPLE 7

2 mm diameter of copper wires defatted with benzene were dipped into 0.1% aqueous solutions of various acid addition salts of 2-undecylimidazole for one hour, washed with distilled water and left in a room to determine the number of days required until the tarnish was observed on the copper wire surface. The test was carried out in a selected place near a viscose plant, which was in an atmospher so rich in sulfurcontaining gas that the un-treated test piece underwent color change in a day. The test results are shown in Table 1.

TABLE 1

| Kind of salt used in the treatment | | number of days required for color change |
|---|---|---|
| Imidazole | Acid | |
| Untreated | | 1 |
| 2-undecyl- | Acetic acid | 30 |
| " | Capric Acid | 3 |
| " | Glycolic acid | 30 |
| " | p-Toluene sulfonic acid | 10 |
| " | Picric acid | 6 |
| " | Oxalic acid | 2 |
| " | Succinic acid | 66 |
| " | Maleic acid | 51 |
| " | Adipic acid | 47 |
| " | Azelaic acid | 31 |
| " | Sebacic acid | 32 |
| " | Salicyclic acid | 2 |
| " | Citric acid | 3 |
| " | Hydrochloric acid | 11 |
| " | Nitric acid | 60 |
| " | Sulfuric acid | 33 |
| " | Phosphoric acid | 40 |

EXAMPLE 8

Number of days was determined until tarnish was observed on the copper wires in the same manner as in Example 7 (dipping in 0.1% aqueous solutions at room temperature for 1 hour). This test was carried out in a place around a viscose sludge settling pond and the testing condition was thereby made more severe. The test results are shown in Table 2.

TABLE 2

| Name of rust-preventing agent | Number of days required for color change |
|---|---|
| Untreated | ½ |
| 2-undecylimidazole phosphate | 9 |
| " maleate | 9 |
| " sebacate | 7 |
| " glycolate | 3 |
| " succinate | 4 |
| " sulfate | 21 |
| 2-undecyl-4-methylimidazole phosphate | 10 |

EXAMPLE 9

A brass rod (5 mm $\phi$ and 20 mm long) was used a test piece. The brass rod was washed with dilute nitric acid, and then the clinging nitric acid was washed off with distilled water. Then the cleaned brass rod was dipped into a 0.1% aqueous solution of 2-undecyl-4-methylimidazole phosphate at room temperature for 1 hour washed with city water and left in a desiccator containing 2–3 ppm of hydrogen sulfide. On the other hand, the test piece subjected to the similar treatment using a 0.25% aqueous solution of benzotriazole in place of 2-undecyl-4-methylimidazole phosphate was left in the desiccator for comparison. As a result, the test piece subjected to the benzotriazole treatment underwent color change after 1.5 days, whereas the test piece subjected to the 2-undecyl-4-methylimidazole phosphate treatment did not undergo color change even after 4 days.

EXAMPLE 10

The surface treatment was carried out in the same manner as in Example 1, using 2-heptadecyl-4-methylimidazole in place of 2-undecyl-4-methylimidazole, and almost same result was obtained.

EXAMPLE 11

2-cm square copper plates, which had been polished with sand paper, defatted with benzene and washed with an aqueous solution of potassium cyanide, were boiled in 0.1% aqueous solutions of various acid addition salts of 2-heptadecylimidazoles for one hour, washed with distilled water and left in a room to determine how many days are required until the tarnish was observed on the copper surface. The test was carried out in a selected place near a carbon disulfide plant, of which atmosphere was so rich in sulfur-containing gas that the untreated test piece underwent color change in only a day. The test results are shown in Table 3.

TABLE 3

| Kind of salt used in the treatment | | number of days required for color change |
|---|---|---|
| Imidazole | Acid | |
| Untreated | | 1 |
| 2-heptadecyl | Acetic acid | 15 |
| " | Glycolic acid | 10 |
| " | p-Toluene sulfonic acid | 5 |
| " | Picric acid | 2 |
| " | Oxalic acid | 2 |
| " | Succinic acid | 32 |
| " | Maleic acid | 25 |
| " | Adipic acid | 16 |
| " | Azelaic acid | 10 |
| " | Sebacic acid | 10 |
| " | Hydrochloric acid | 4 |
| " | Nitric acid | 15 |
| " | Sulfuric acid | 11 |
| " | Phosphoric acid | 10 |
| 2-heptadecyl-4-methylimidazole | Phosphoric acid | 20 |
| " | Sulfuric acid | 15 |

EXAMPLE 12

0.1 g of 2-undecyl-4-methylimidazole was dissolved in 100 ml of lubricating oil (spindle oil), and the oil was then impregnated with a paper. The oil-impregnated paper was extended and laid on a polished copper plate surface. The plates were stored in a vessel containing 10 ppm of hydrogen sulfide at room temperature to investigate the degree of color change. As a result, no color change was observed even after 20 days in the case of laying the paper containing 2-undecyl-4-methylimidazole, but complete color change was observed after about 4 days in the case of laying the paper free of 2-undecyl-4-methylimidazole.

We claim:

1. A method for preventing discoloration of copper or copper alloy, subsequently exposed to a gaseous atmosphere containing sulfur compounds, which method comprises surface-treating the copper or copper alloy with at least one compound selected from the group consisting of alkylimidazoles represented by the general formula:

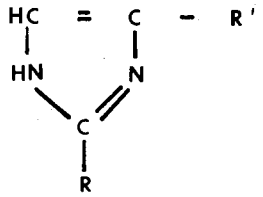

wherein R is a long straight chain alkyl group having 5–21 carbon atoms and R′ is a hydrogen atom or a lower alkyl group, and acid addition salts of said alkylimidazoles thereby to coat said surface with micelles of said alkylimidazoles which act to prevent discoloration of said copper or copper alloy.

2. A method according to claim 1, wherein the surface treatment is carried out by dipping the copper or copper alloy in a solution containing at least one compound selected from the group consisting of said alkylimidazoles and their acid addition salts.

3. A method according to claim 1, wherein the surface treatment is carried out by coating the copper or copper alloy with a solution containing at least one compound selected from the group consisting of said alkylimidazoles and their acid addition salts.

4. A method according to claim 1, wherein the surface treatment is carried out by spraying a solution containing at least one compound selected from the group consisting of the alkylimidazoles and their acid addition salts onto said copper or copper alloy.

5. A method according to claim 1, wherein the surface treatment is carried out with use of a solution containing an amine in addition to at least one compound selected from the group consisting of said alkylimidazoles and their acid addition salts, in a concentration of at least 0.01% by weight.

6. A method according to claim 1, wherein the surface treatment is carried out with use of a solution containing at least one of compound selected from the group consisting of said alkylimidazoles and their acid addition salts, in a concentration of at least 0.01% by weight.

7. A method according to claim 1, wherein the surface treatment is carried out with the use of said a solution of alkylimidazoles in an organic solvent.

8. A method according to claim 1, wherein the surface treatment is carried out with use of a solution of acid addition salts of said alkylimidazoles in water.

9. A method according to claim 1, wherein the surface treatment is carried out with use of a solution of alkylimidazoles or their acid addition salts in a mixed medium of water and an organic solvent.

10. A method according to claim 1, wherein the surface treatment is carried out with use of a solution of said alkylimidazoles added with a solution of an acidic substance.

11. A method according to claim 10, wherein the solution contains at least one of the compound selected from the group consisting of said alkylimidazoles and their acid addition salts, in a concentration ranging from 0.05 to 5% by weight.

12. A method according to claim 1, wherein the compound is 2-undecylimidazole or an acid addition salt thereof.

13. A method according to claim 1, wherein the compound is 2-undecyl-4-methylimidazole or an acid addition salt thereof.

14. A method according to claim 1, wherein the compound is 2-heptadecylimidazole or an acid addition salt thereof.

15. A method according to claim 1, wherein the compound is 2-heptadecyl-4-methylimidazole or an acid addition salt thereof.

16. Copper or copper alloy which is resistant to discoloration when exposed to a gaseous atmosphere containing sulfur compounds and whose surface has been treated with at least one compound selected from the group consisting of alkylimidazoles represented by the general formula

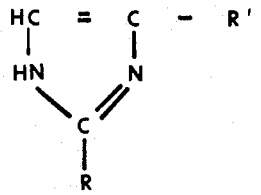

wherein R is a long straight chain alkyl group having 5–21 carbon atoms and R′ is a hydrogen atom or a lower alkyl group, and acid addition salts of said alkylimidazoles.

17. Copper or copper alloy according to claim 16, wherein the compound is 2-undecylimidazole or an acid addition salt thereof.

18. Copper or copper alloy according to claim 16, wherein the compound is 2-undecyl-4-methylimidazole or an acid addition salt thereof.

19. Copper or copper alloy according to claim 16, wherein the compound is 2-heptadecylimidazole or an acid addition salt thereof.

20. Copper or copper alloy according to claim 16, wherein the compound is 2-heptadecyl-4-methylimidazole or an acid addition salt thereof.

21. A method for producing copper or copper alloy which is resistant to discoloration when subsequently exposed to a gaseous atmosphere containing sulfur compounds which method comprises treating the surface of said copper alloy with at least one compound selected from the group consisting of alkylimidazoles represented by the general formula:

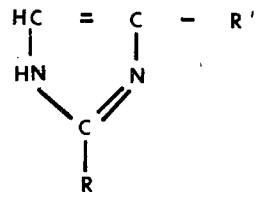

wherein R is a long straight chain alkyl group having 5–21 carbon atoms and R′ is a hydrogen atom or a lower alkyl group, and acid addition salts of said alkylimidazoles thereby to coat said surface with micelles of said alkylimidazoles which act to prevent discoloration of said copper or copper alloy.

* * * * *